US007490832B2

(12) United States Patent
Gaylor

(10) Patent No.: US 7,490,832 B2
(45) Date of Patent: Feb. 17, 2009

(54) HARDWAY

(76) Inventor: Edward Appleton Gaylor, 265 Long Hill Rd., Little Falls, NJ (US) 07424

( * ) Notice: Subject to any disclaimer, the term of this patent is extended or adjusted under 35 U.S.C. 154(b) by 833 days.

(21) Appl. No.: 10/425,812

(22) Filed: Apr. 29, 2003

(65) Prior Publication Data

US 2005/0258593 A1 Nov. 24, 2005

Related U.S. Application Data

(63) Continuation-in-part of application No. 10/387,928, filed on Mar. 13, 2003, and a continuation-in-part of application No. 10/051,947, filed on Jan. 22, 2002, now abandoned.

(51) Int. Cl.
*A63F 3/00* (2006.01)

(52) U.S. Cl. ..... 273/236; 273/246; 273/292

(58) Field of Classification Search ..... 273/236, 273/246, 268; 463/6, 22
See application file for complete search history.

(56) References Cited

U.S. PATENT DOCUMENTS

| | | | | | |
|---|---|---|---|---|---|
| 3,057,623 | A | | 10/1962 | Barnes | |
| 4,042,245 | A | | 8/1977 | Zarour | |
| 4,060,246 | A | * | 11/1977 | Ward | 273/277 |
| 4,986,546 | A | | 1/1991 | Cerulla | |
| 5,226,655 | A | | 7/1993 | Rickabaugh | |
| 5,322,293 | A | | 6/1994 | Goyette | |
| 5,388,835 | A | | 2/1995 | Albright | |
| 5,564,709 | A | | 10/1996 | Smoika | |
| 5,728,002 | A | * | 3/1998 | Hobert | 463/17 |
| 5,749,582 | A | | 5/1998 | Fritz et al. | |
| 5,839,726 | A | * | 11/1998 | Luise | 273/246 |

* cited by examiner

*Primary Examiner*—Dmitry Suhol
*Assistant Examiner*—Alex F R P Rada, II

(57) ABSTRACT

Hardway is an invention which deals with a new way of dealing with games which involve throwing a pair of dice and moving game pieces. It is unique, because the corresponding pieces are moved based on the sum of 2 dice on a unique layout with unique rules, and also because this same layout incorporates most aspects of the game of craps.

5 Claims, 5 Drawing Sheets

HARDWAY

Figure 1:
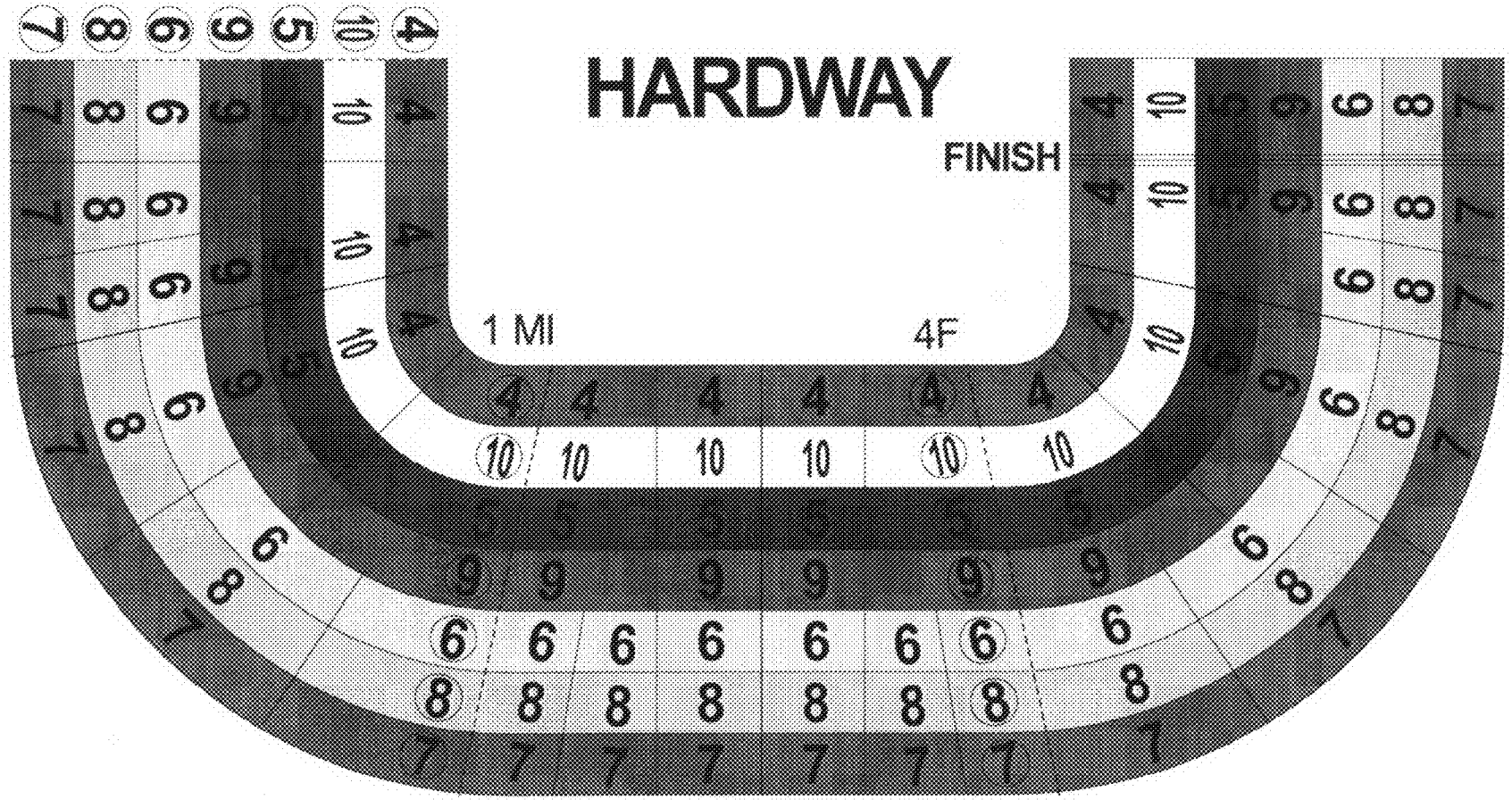

This non-provisional application is a Continuation-in-part of the previous non-provisional application Ser. No. 10/051,947 which had a filing date of Jan. 22, 2002, and also is a Continuation-in-part of the previous non-provisional application Ser. No. 10/387,928 which had a filing date of Mar. 13, 2003.

CROSS REFERENCE TO RELATED APPLICATIONS

This non-provisional application is a Continuation-in-part of the previous non-provisional application Ser. No. 10/051,947 which had a filing date of Jan. 22, 2002 now abandoned, and also is a Continuation-in-part of the previous non-provisional application Ser. No. 10/387,928 which had a filing date of Mar. 13, 2003.

This new application is related to the previous applications in that it contains one new drawing (FIG. 3) which is a variation of one of the previous drawings (FIG. 2), and also contains further related explanation of this new drawing.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF INVENTION (1) Field of the Invention

This invention pertains to the general field of endeavor relating to games which are played by throwing a pair of dice and moving pieces, and betting on the outcome of the dice.

(2) Description of Related Art

U.S. Pat. No. 3,057,623 (B. P. Barnes, 10-1962)—It could be said that any board game which involves squares and the movement of pieces, would have some sort of ratio between the number of squares that each piece has to travel to win; but in Barnes' Jockey Game this ratio is not the same as in my game (3:2), nor does it relate to a "normal" pair of dice (numbered 1 to 6 on each side). The 3:2 ratio in my playing surface, incorporated with the mathematical rules of probability for the outcome of random rolls for two normal dice, and the method described in this application for playing my game result in a unique and very even horse race. Also, my game includes the craps aspects, which Barnes' game does not.

U.S. Pat. No. 5,388,835 (Kevin Albright, 02-1995)—Although Albright's game involves a "double move" when two of the same numbers appear on any two of the dice, this is related to the player having an extra roll as opposed to the playing piece being moved additional squares from the same roll. Also, this game involves 3 dice where the total on the dice determines how many squares a particular piece (the particular piece is moved based on the outcome of a separate spinner) moves.—This is quite different from my game where the total on two dice determine which piece moves 1 square (and sometimes 2 if a double is thrown). Also, the number of potential squares to be moved in this game by a particular piece on a Given roll (up to 18) could be problematic and prone to error as it relates to my game. Also, my game includes the craps aspects, which Albright's game does not.

U.S. Pat. No. 5,226,655 (Harry W. Rickabaugh 07-1993)—It could be said that any board game which involves squares and the movement of pieces, would have some sort of ratio between the number of squares that each piece has to travel to win; but in Rickbaugh's game this ratio is not the same as in my game (3:2). The 3:2 ratio in my playing surface, incorporated with the mathematical rules of probability for the outcome of random rolls for two normal dice, and the method described in this application for playing my game result in a unique and very even horse race. Also, my game includes the craps aspects, which Rickabaugh's game does not.

U.S. Pat. No. 5,749,582 (Fritz et al. 05-1998)—It could be said that any board game which involves squares and the movement of pieces, would have some sort of ratio between the number of squares that each piece has to travel to win; but in Fritz's game this ratio is not the same as in my game (3:2). The 3:2 ratio in my playing surface, incorporated with the mathematical rules of probability for the outcome of random rolls for two normal dice, and the method described in this application for playing my game result in a unique and very even horse race. Also, my game includes the craps aspects, which Fritz's game does not.

U.S. Pat. No. 4,042,245 (Louis Yacoub Zarour 08-1977)—It could be said that any board game which involves squares and the movement of pieces, would have some sort of ratio between the number of squares that each piece has to travel to win; but in Zarour's game this ratio is not the same as in my game (3:2). The 3:2 ratio in my playing surface, incorporated with the mathematical rules of probability for the outcome of random rolls for two normal dice, and the method described in this application for playing my game result in a unique and very even horse race. Also, my game includes the craps aspects, which Zarour's game does not.

U.S. Pat. No. 5,564,709 (Richard G. Smoika 10-1996)—It could be said that any board game which involves squares and the movement of pieces, would have some sort of ratio between the number of squares that each piece has to travel to win; but in Smoika's game this ratio is not the same as in my game (3:2). The 3:2 ratio in my playing surface, incorporated with the mathematical rules of probability for the outcome of random rolls for two normal dice, and the method described in this application for playing my game result in a unique and very even horse race. Also, my game includes the craps aspects, which Smoika's game does not.

U.S. Pat. No. 5,322,293 (Daniel A. Goyette 06-1994)—It could be said that any board game which involves squares and the movement of pieces, would have some sort of ratio between the number of squares that each piece has to travel to win; but in Goyette's game this ratio is not the same as in my game (3:2). The 3:2 ratio in my playing surface, incorporated with the mathematical rules of probability for the outcome of random rolls for two normal dice, and the method described in this application for playing my game result in a unique and very even horse race. Also, my game includes the craps aspects, which Goyette's game does not.

I am also the inventor of a board game named Hardway which makes use of the horserace aspect of this idea but is quite different in many respects—both in layout and in method of play. Although my board game has been in the public domain for more than one year, its use of this invention is not specifically explained, and additionally, my board game does not include the certain aspects of craps previously mentioned.—Also, in the board game you can bet on all the horses except the 7-horse, and you only lose when the 7-horse wins, and you only win when the horse you bet on wins—else your bet(s) are returned. In this application that I am submitting for a patent, you can bet on all the horses, including the 7-horse, and you win when the horse you bet on wins and you lose when the horse you bet on loses. (This method of allowing betting on the 7-horse is better because it is easier to understand for the player, and there are more decisions per hour for the casino.) Also, in the board game the players are issued different color chips from the other players to distinguish their bets which are made in a common betting area for each horse.—In this application that I am submitting for a patent, the lanes of the races track have been widened (in comparison to the board game) so that they can accommodate normal casino-sized chips.—The players can then use the casino's regular chips for betting right on the racetrack in areas that are directly in front of each player, and there is no need for colored or special chips (as in the board game) to distinguish player bets from one another. Also, this application that I am submitting for a patent has the basic shape of the playing surface from the board game altered so that it will fit onto a "blackjack" type table that is commonly used in a casino. Additionally, several features of a normal craps game have cleverly been added so that the horserace and craps game are played simultaneously on the same playing surface. The combination of the idea not being obvious in the board game, the alteration to the original board game playing shape—betting areas and rules for method of play, the addition of the aspects of craps, and the fact that everything here were my original ideas (the unique layout and rules); should make this invention eligible for a patent.

In my previous non-provisional application (No. 10/051,947—filing date Jan. 22, 2002), I was unaware of the USPTO website containing search capabilities on previous patents.—Having Now searched this website, I have found some existing or expired patents that have some similar features to my game, which I previously knew nothing about. The following is discussion of these patents, how they are different from my application, and what features of my game are improved differences.

U.S. Pat. No. 4,986,546 (Cerulla—Jan. 22, 1991)—This patent involves a horse racing game where 3 dice are used: 2 dice are the same color, and the 3rd die is a different color from the other two that are the same. The 2 dice that are the same determine which 2 horses to move, and the 3rd die indicates how many squares.—This game is quite different from mine, because of the 3 dice and how they are used to determine which horse(s) move and how many squares. Also, the horse numbers used are 1, 2, 3, 4, 5, 6, as opposed to my game which uses horse numbers 4, 5, 6, 7, 8, 9, 10. In my game, a horse moves 1 or 2 squares based on the total of 2 dice, the board layout is very different with its built in 3:2 ratio, and of course, my game includes the craps aspects, which this game does not.

U.S. Pat. No. 5,839,726 (Luise—Nov. 24, 1998)—This patent involves a horse racing game where 3 dice are used. If 2 sixes and I three were thrown for example, then the 6-horse would move 2 squares, and the 3-horse would move 1 square. This game is quite different from mine, because of the 3 dice and how they are used to determine which horse(s) move and how many squares. Also, the horse numbers used are 1, 2, 3, 4, 5, 6, as opposed to my game which uses horse numbers 4, 5, 6, 7, 8, 9, 10. In my game, a horse moves 1 or 2 squares based on the total of 2 dice, the board layout is very different with its built in 3:2 ratio, and of course, my game includes the craps aspects, which this game does not.

U.S. Pat. No. 4,060,246 (Ward—Nov. 29, 1977 (expired, I believe))—This patent involves a horse racing game where 2 dice are used, and is the most similar patent to my game that I could find, but still has many differences. The horses move based on the total of the two dice, and horses move a certain number of squares (length of gallops) based on a chart in the patent. This chart is based on the expected proportion between the horses. For example: the 4-horse's 'gallop' is twice as long as the 7-horse's gallop because the outcome of a 4 is one half as likely as the outcome of a 7. Another example of the setup for L. Ward's game would be that the 2-horse's gallop is six times as long as the 7-horse's gallop because the outcome of a 2 is one sixth as likely as the outcome of a 7. This is supposed to provide for an exactly even race, but in fact it does not as the expected winning probability for the 7-horse in this game would be approximately 0.02, and the expected winning probability for 2-horse would be approximately 0.22.—This is for the "1 gallop(s) to finish" for the 2-horse vs. "6 gallops to finish" for the 7-horse (or 1-furlong race) version of L. Ward's game.—These expected winning probabilities are not very close.—I will explain in the next paragraph why even though the theory behind L. Ward's patent seems correct, in reality it is not.—My game is again different from this game because the layout for the horse race incorporates the expected probabilities basically into the game board, instead of incorporating the probabilities into the length of the moves.—i.e. My game has less squares proportionally for the 4-horse vs. the 7-horse, instead of having the 4-horse covering more squares (as opposed to the 7-horse) when it moves in L. Ward's game. Also, U.S. Pat. No. 4,060,246 (Ward—Nov. 29, 1977), does not have double moves for the doubles (22, 33, 44, 55) and the proportional squares to handle this or the special moves for the 7-horse on a total of 2, 3, 11, or 12. Also, L. Ward's game has horses numbered 2, 3, 4, 5, 6, 7, 8, 9, 10, 11, 12, as opposed to my game which uses horse numbers 4, 5, 6, 7, 8, 9, 10. And finally, of course, my game includes the craps aspects and U.S. Pat. No. 4,060,246 (Ward—Nov. 29, 1977) does not.

Here is an explanation of why the horses in U.S. Pat. No. 4,060,246 (Ward—Nov. 29, 1977) do not have a very even chance of winning. Let's just take the 2-horse vs. the 7-horse and a 1 furlong race for simplicity. In U.S. Pat. No. 4,060,246 (Ward—Nov. 29, 1977) the 2-horse would have 1 gallop to win (length of gallop is 60) and 7-horse would have 6 gallops to win (length of gallop is 10). This is basically based on the fact that if you threw 2 dice 36 times, you would expect six-7s (total of dice is 7) and one-2 (total of dice is 2) to be in your outcome.—Here's the problem: if you threw the dice 19 times, then the probability of one 2 (total of dice) being thrown is greater than 0.5, whereas the probability of six-7s (total of dice is 7) being thrown is far less than 0.5. As a matter of fact, the probability of six-7s (total of 7) being thrown does not exceed 0.5 until the 34th throw.—Therefore we can see that in this example basically, the 2-horse has a much better chance of winning (approximately 0.22) than the 7-horse (0.02). Remember that once the 2-horse moves one square, he wins and the race is over. In the discussion of my game farther down in this section, I will explain where these probabilities came from.

In general, none of these patents (U.S. Pat. No. 4,986,546—Cerulla—Jan. 22, 1991, U.S. Pat. No. 5,839,726—Luise—Nov. 24, 1998, U.S. Pat. No. 4,060,246—Ward—Nov. 29, 1977) involve the craps aspects in addition to the horse race. This is a very important difference and improvement with my game. My horse race flows as a natural offshoot of a craps game which is being played on the same playing surface simultaneously. This is a very important aspect to the casino that will be running my game. The casino will not only generate the revenue that they would normally get from the craps aspect of my game, but they will also be generating revenue from the horse race, simultaneously.—This is a very important advantage of my game because a horserace by itself will not generate as many decisions (bets paid or collected) per hour as a casino would normally like to have.

The following is a discussion of the expected probabilities of winning for the horses in my game: In the 4-furlong race, the 6, 7, & 8 horses have 6-squares to cover and the 4, 5, 9, & 10 horses have 4 squares to cover. This ratio of squares (3:2) between the 6, 7, or 8 horses and the 4, 5, 9, or 10 horses, combined with the rule that even numbered horses (4, 6, 8, 10) move 2 squares when a corresponding hardway (doubles) is thrown, plus the rule for the 7-horse that it (the 7-horse) on a come out roll only (come out is a term/rule that pertains to the game of craps), moves 2 squares forward when an 11 thrown, and one 1 square backwards when craps (a total of 2, 3, or 12) is thrown; results in a very even race for the horses. At first glance, one might think that the probability of winning would be exactly even for each horse, but even though it is very close, it is not exactly even but within a few hundredths—which produces a very 'even' horse race. With 36 rolls of the dice, you would expect on average six-7s, five-8s, five-6s, four-5s, four-9s, three-4s, and three-10s; and in fact this is what you would get. (The 4, 6, 8, 10 horses have an extra square to cover because they move 2 squares forward on doubles.) Additionally, you would expect four-craps (2-3-3-12) and two-11s. In order to compute the theoretical probability for my game you would have to write down all the possible states that the seven horses could be in (55,296), and then figure out the probability for each of these states. Then put these probabilities along with their associated probabilities of moving from one state to the next in a 55,303×55,303 matrix.—This is of course an unreasonable and almost impossible task, so a simulation program was written to generate the expected probabilities of winning for the seven horses. (Simulation is an accepted method for predicting expected probabilities, particularly when a theoretical proof is impossible or impracticable.) Using a random number generator (and verifying that the numbers that were generated followed the expected probabilities for two, fair, 6-sided dice—numbered 1, 2, 3, 4, 5, 6 on each die) and simulating 660,000,000 rolls of the dice for my 4-furlong race, I obtained the following results:

The 4 or 10 horse's expected probability of winning would be 0.174285905

The 5 or 9 horse's expected probability of winning would be 0.141276290

The 6 or 8 horse's expected probability of winning would be 0.114579681

The 7 horse's expected probability of winning would be 0.139716249

These numbers for my 4-furlong race are close enough to produce very even racing, which is what you want. The odds paid by the casino can be adjusted according to a particular horse's probability to gain the expected house advantage that the casino desires. For example, if the 4-horse was given pay-out odds of 4-1, and the 5-horse was given pay-out odds of 5-1, then the expected house advantage for the 4-horse would be 12.85% and the expected house advantage for the 5-horse would be 15.22%. These advantages are in line with the number of rolls to finish an average race of this length (18.1 rolls).

I altered my program to run simulations for U.S. Pat. No. 4,060,246 (Ward—Nov. 29, 1977) for expected outcomes for 200,000,000 random rolls of the dice (3 furlong race), and obtained the following results:

The 2 or 12 horse's expected probability of winning would be 0.219416205

The 3 or 11 horse's expected probability of winning would be 0.112687414

The 4 or 10 horse's expected probability of winning would be 0.070255134

The 5 or 9 horse's expected probability of winning would be 0.048487350

The 6 or 8 horse's expected probability of winning would be 0.035565865

The 7 horse's expected probability of winning would be 0.027176063

It is evident that U.S. Pat. No. 4,060,246 (Ward—Nov. 29, 1977) does not produce even racing.

Simulating 200,000,000 random rolls of the dice for my 1 mile race, I obtained the following results:

The 4 or 10 horse's expected probability of winning would be 0.174399455

The 5 or 9 horse's expected probability of winning would be 0.138760759

The 6 or 8 horse's expected probability of winning would be 0.116706445

The 7 horse's expected probability of winning would be 0.140266683

Simulating 200,000,000 random rolls of the dice for my 1½ mile race, I obtained the following results:

The 4 or 10 horse's expected probability of winning would be 0.174808034

The 5 or 9 horse's expected probability of winning would be 0.137566845

The 6 or 8 horse's expected probability of winning would be 0.117543818

The 7 horse's expected probability of winning would be 0.140162606

The results for the 1 mile and 1½ mile races for my game continue to produce very even racing which is very similar to my 4-furlong race.

BRIEF SUMMARY OF THE INVENTION

Most games involving the throwing of dice and the movement of pieces have one of the following 2 characteristics:

1. One die is thrown and the corresponding piece (#1, #2, #3, #4, #5, #6) is moved one square.
2. 2 dice are thrown and the person whose turn it is moves their piece a number of squares corresponding to the total of the numbers on the 2 dice.

But what about throwing 2 dice and having the piece move that corresponds to the total of the numbers on the 2 dice?—This would not be fair, because for example: the #7 piece would get to move much more often that the #10 piece.—My invention solves this problem in a unique manner.—This is done by having a game playing surface where the ratio of the number of squares, for each of the different numbered pieces, corresponds to its mathematical probability. Additionally, certain aspects of the game of craps are added and combined with the playing surface mentioned in the previous sentence, to create a new and unique game. Combining the horserace and craps game into one playing surface where both games are played simultaneously, solves the problem for a casino of not having enough decisions per hour from the horserace alone.—More detailed explanation is given in the 'Detailed Description of the Invention' and 'Background' SECTIONS.

BRIEF DESCRIPTION OF THE SEVERAL VIEWS OF THE DRAWING(S)

FIG. 1 illustrates a game layout where the ratio of the number of squares for the 6, 7, or 8 horses as compared to 4, 5, 9, or 10 horses is 3:2.

There are 3 different starting points in the enclosed diagram which all incorporate this 3:2 ratio: 1½ miles (18:12), 1 mile (2:8), 4 F or 4 furlongs (6:4).

Figure 2:
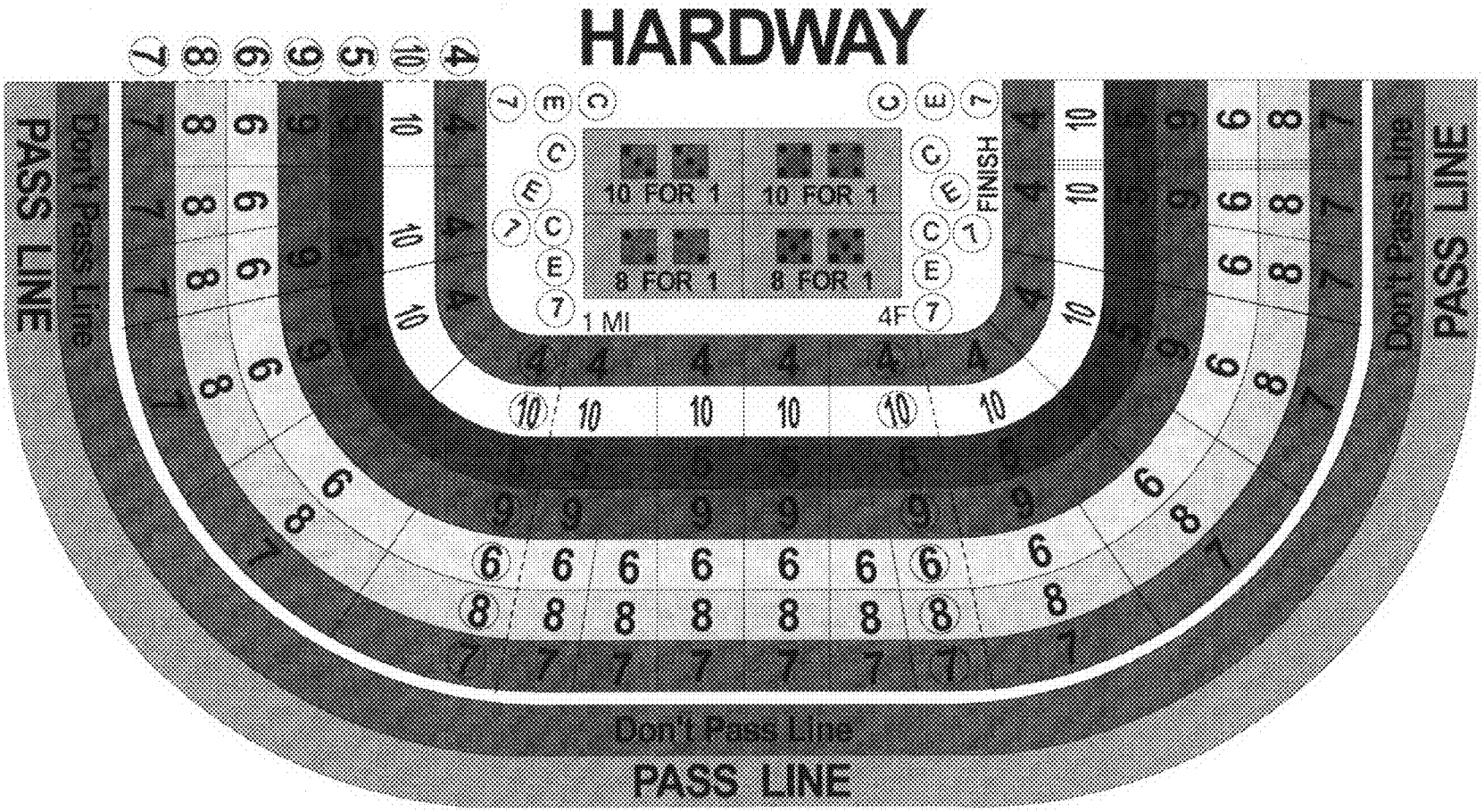

FIG. 2 illustrates the horserace track combined with certain aspects of the game of craps. In addition to being able to bet on the horses, players can bet on the Pass-Line, Don't-Pass-Line, Place bets, Hardways, C-E-7 bets (any-Craps, Eleven, 7 bets), Take odds, or Lay odds. (The terms in the previous sentence are all known terms to the game of craps).

People would bet on any or all of the horses (4, 5, 6, 7, 8, 9, 10). These bets are 'capped' with special chips that say "Race Closed" that are placed on top of the betting chips. This means that once a race starts, there is no more horse-betting until the next race. The horse pieces used in my game are chess knights. When one of these horses wins (crosses the finish line first), money is paid at pre-determined house odds to the players with bets on the winning horse—bets on the other horses lose. All races start on a come out roll. When a race ends, the next race does not start until the next come out roll. Basically what happens is that the players make their horse bets, the bets are capped by the dealer, then the players make their craps bets. The dice are thrown by whomever happens to be the shooter for the craps game, and the craps game available bets are made and paid as they normally would be paid. While the players are throwing the dice and playing the craps part of the game, the dealer moves the horses on the racetrack part of the game, based on the same total of the same dice.

Figure 3:
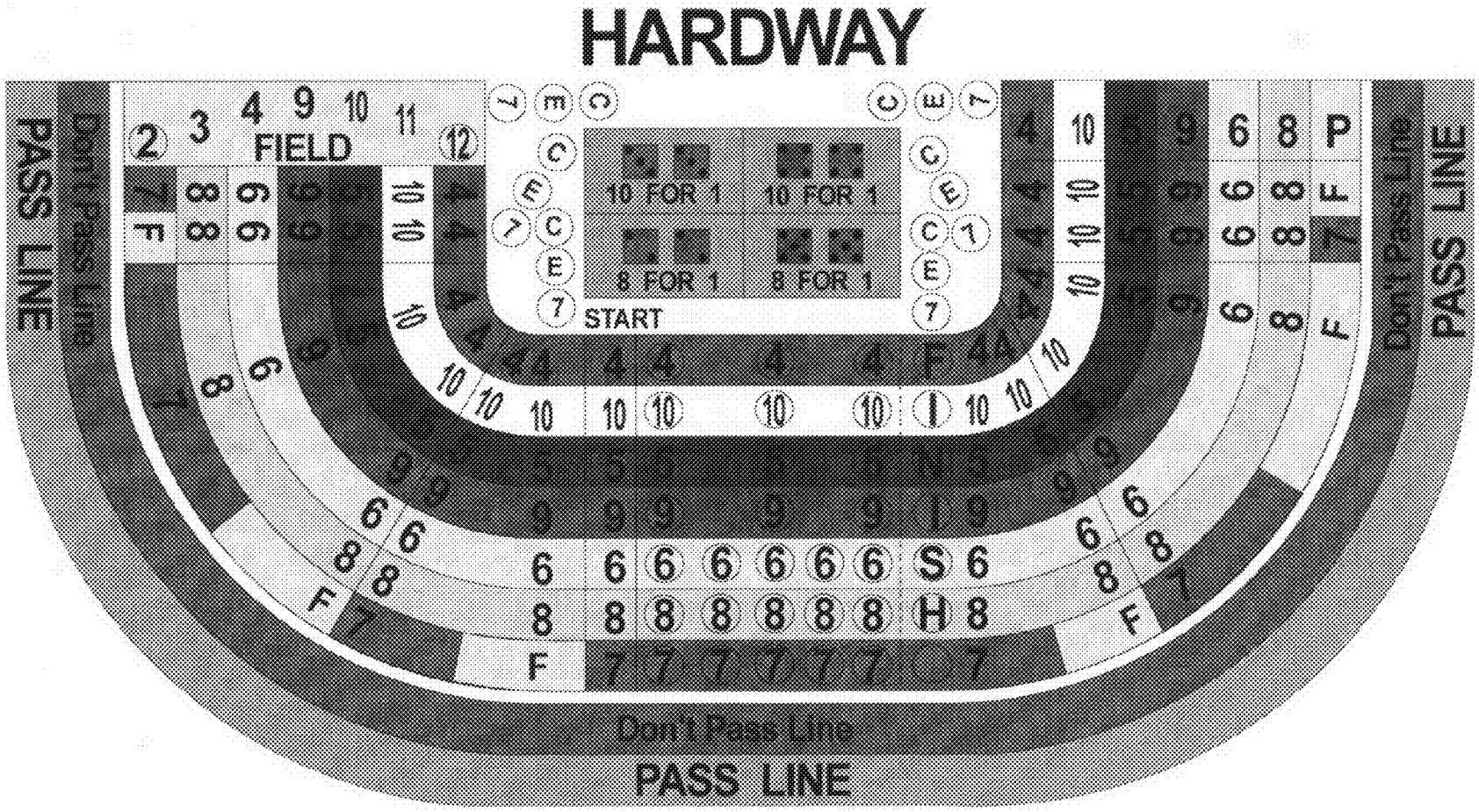

FIG. 3 is a variation of FIG. 2. One difference is that the 4 F (4 furlong) race has been moved to the center of the playing surface, with the other two race lengths and starting points (1 mile and 1½ mile) being eliminated. The ratio of squares for the horses to cover is still the same as in FIG. 1 and FIG. 2. Additionally the 'FIELD' bet (a normal accepted bet in the game of craps) has been added. The advantages to this layout are that casinos may only want to run the 4-furlong race; the horse racing area is separated from where players place their chips; and the 'FIELD' bet has been added for the players.

Figure 4:
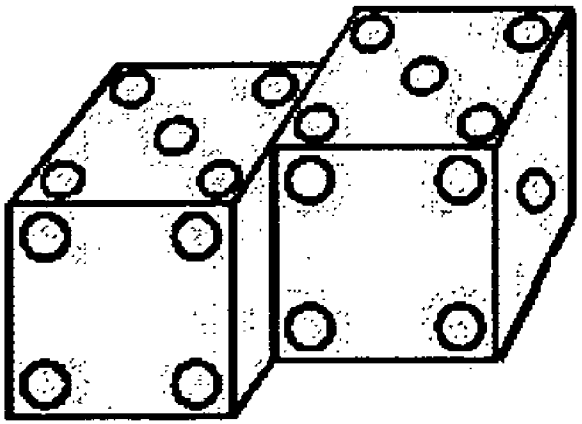

FIG. 4 illustrates the two 6-sided dice used in playing my game, each of which is a cube and has a number of dots on each side (surface) corresponding to the numbers 1, 2, 3, 4, 5, and 6.

Figure 5:
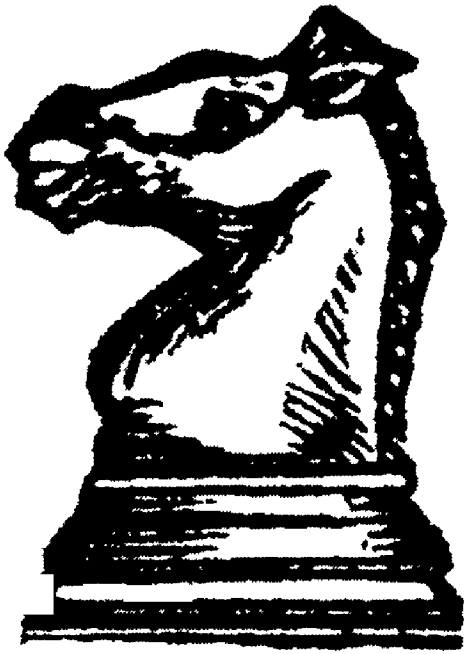

FIG. 5 illustrates what each one of the horses would look like (chess knights), used in playing my game.

DETAILED DESCRIPTION OF THE INVENTION

My invention takes into account the following:

1. The piece numbers that are used are the numbers 4, 5, 6, 7, 8, 9, and 10.
2. From this point on, the piece numbers in the previous sentence (# 1.), will be referred to as the 4-horse, 5-horse, 6-horse, 7-horse, 8-horse, 9-horse, and 10-horse, respectively. (FIG. 5)
3. A pair of 'normal' dice (FIG. 4) is used (i.e. each die is a 6-sided cube and has a number of dots on each side (surface) corresponding to the numbers 1, 2, 3, 4, 5, or 6). dice that are used at a casino craps table should be used to make sure that they are perfectly balanced.
4. The ratio of the number of squares for the 6, 7, or 8 horses as compared to the 4, 5, 9, or 10 horses would be 3 to 2. For example: the 7-horse could have 18 squares to move to win, and the 9-horse could have 12 squares to move to win.
5. This ratio is completed by having the 4, 6, 8, and 10 horses move 2 squares on a double (or Hardway), whose sum corresponds to the particular horse. (e.g. the 8-horse would move 2 squares forward on a double 4).
6. Additionally, whenever it is a come out roll during the craps game, which is incorporated into the same playing surface as the horse race, and is being played simultaneously; the 7-horse moves 2 squares forward when a sum of 11 is thrown, and 1 square backwards when a sum of (2, 3, or 12) (craps) is thrown.
7. The following is a detailed description of the method for moving the horses, based on the outcome of the dice:

if there is a '1' facing up on one die and a '3' facing up on the other die, resulting in a total of '4', then the 4-horse would move 1 square forward;

if there is a '3' facing up on one die and a '1' facing up on the other die, resulting in a total of '4', then the 4-horse would move 1 square forward;

if there is a '2' facing up on one die and a '2' facing up on the other die (also known as "doubles" or known as a hardway in craps), resulting in a total of '4', then the 4-horse would move 2 squares forward;

if there is a '1' facing up on one die and a '4' facing up on the other die, resulting in a total of '5', then the 5-horse would move 1 square forward;

if there is a '4' facing up on one die and a '1' facing up on the other die, resulting in a total of '5', then the 5-horse would move 1 square forward;

if there is a '2' facing up on one die and a '3' facing up on the other die, resulting in a total of '5', then the 5-horse would move 1 square forward;

if there is a '3' facing up on one die and a '2' facing up on the other die, resulting in a total of '5', then the 5-horse would move 1 square forward;

if there is a '1' facing up on one die and a '5' facing up on the other die, resulting in a total of '6', then the 6-horse would move 1 square forward;

if there is a '5' facing up on one die and a '1' facing up on the other die, resulting in a total of '6', then the 6-horse would move 1 square forward;

if there is a '2' facing up on one die and a '4' facing up on the other die, resulting in a total of '6', then the 6-horse would move 1 square forward;

if there is a '4' facing up on one die and a '2' facing up on the other die, resulting in a total of '6', then the 6-horse would move 1 square forward;

if there is a '3' facing up on one die and a '3' facing up on the other die (also known as "doubles" or known as a hardway in craps), resulting in a total of '6', then the 6-horse would move 2 squares forward;

if there is a '1' facing up on one die and a '6' facing up on the other die, resulting in a total of '7', then the 7-horse would move 1 square forward;

if there is a '6' facing up on one die and a '1' facing up on the other die, resulting in a total of '7', then the 7-horse would move 1 square forward;

if there is a '2' facing up on one die and a '5' facing up on the other die, resulting in a total of '7', then the 7-horse would move 1 square forward;

if there is a '5' facing up on one die and a '2' facing up on the other die, resulting in a total of '7', then the 7-horse would move 1 square forward;

if there is a '3' facing up on one die and a '4' facing up on the other die, resulting in a total of '7', then the 7-horse would move 1 square forward;

if there is a '4' facing up on one die and a '3' facing up on the other die, resulting in a total of '7', then the 7-horse would move 1 square forward;

if there is a '2' facing up on one die and a '6' facing up on the other die, resulting in a total of '8', then the 8-horse would move 1 square forward;

if there is a '6' facing up on one die and a '2' facing up on the other die, resulting in a total of '8', then the 8-horse would move 1 square forward;

if there is a '3' facing up on one die and a '5' facing up on the other die, resulting in a total of '8', then the 8-horse would move 1 square forward;

if there is a '5' facing up on one die and a '3' facing up on the other die, resulting in a total of '8', then the 8-horse would move 1 square forward;

if there is a '4' facing up on one die and a '4' facing up on the other die (also known as "doubles." or known as a hardway in craps), resulting in a total of '8', then the 8-horse would move 2 squares forward;

if there is a '3' facing up on one die and a '6' facing up on the other die, resulting in a total of '9', then the 9-horse would move 1 square forward;

if there is a '6' facing up on one die and a '3' facing up on the other die, resulting in a total of '9', then the 9-horse would move 1 square forward;

if there is a '4' facing up on one die and a '5' facing up on the other die, resulting in a total of '9', then the 9-horse would move 1 square forward;

if there is a '5' facing up on one die and a '4' facing up on the other die, resulting in a total of '9', then the 9-horse would move 1 square forward;

if there is a '4' facing up on one die and a '6' facing up on the other die, resulting in a total of '10', then the 10-horse would move 1 square forward;

if there is a '6' facing up on one die and a '4' facing up on the other die, resulting in a total of '10', then the 10-horse would move 1 square forward;

if there is a '5' facing up on one die and a '5' facing up on the other die (also known as "doubles." or known as a hardway in craps), resulting in a total of '10', then the 10-horse would move 2 squares forward;

if it is the "come out" roll in the craps game which is being played simultaneously and there is a '1' facing up on one die and a '1' facing up on the other die (also known as "craps" in craps), resulting in a total of '2', then the 7-horse would move 1 square backwards;

if it is the "come out" roll in the craps game which is being played simultaneously and there is a '1' facing up on one die and a '2' facing up on the other die (also known as "craps" in craps), resulting in a total of '3', then the 7-horse would move 1 square backwards;

if it is the "come out" roll in the craps game which is being played simultaneously and there is a '2' facing up on one die and a '1' facing up on the other die (also known as "craps" in craps), resulting in a total of '3', then the 7-horse would move 1 square backwards;

if it is the "come out" roll in the craps game which is being played simultaneously and there is a '6' facing up on one die and a '6' facing up on the other die (also known as "craps" in craps), resulting in a total of '12', then the 7-horse would move 1 square backwards;

if it is the "come out" roll in the craps game which is being played simultaneously and there is a '5' facing up on one die and a '6' facing up on the other die (also known as "the yo" in craps), resulting in a total of '11', then the 7-horse would move 2 squares forward;

if it is the "come out" roll in the craps game which is being played simultaneously and there is a '6' facing up on one die and a '5' facing up on the other die (also known as "the yo" in craps), resulting in a total of '11', then the 7-horse would move 2 squares forward; resulting in a very even horse race.

8. FIG. 1 shows the layout of the racetrack only, which takes into account this 3:2 ratio.
9. FIG. 2 shows the layout of the racetrack incorporated with certain aspects of a craps game.
10. FIG. 3 is a similar to FIG. 2, but has only one race length (4-furlongs).
11. FIG. 4 shows the two 6-sided dice, each of which is a cube and has a number of dots on each side (surface) corresponding to the numbers 1, 2, 3, 4, 5, and 6.
12. FIG. 5 shows what each one of the horses would look like (chess knights).

I claim:

1. A method of playing a game on a playing surface which combines horse racing lanes and certain aspects of craps in the same surface where the method is comprised of the following steps:

prior to start of the game providing a game layout on a gaming table which is comprised of:

seven horse racing lanes each with a starting and finishing point for seven different horse playing pieces, each lane being divided into a number of squares where if the starting point of the race is at the 1½—mile point, the horses numbered 6, 7, and 8 each have 18 squares to cover before they reach the finish line and the horses numbered 4, 5, 9, and 10 each have 12 squares to cover before they reach the finish line— where if the starting point of the race is at the 1-mile point, the horses numbered 6, 7, and 8 each have 12 squares to cover before they reach the finish line and the horses numbered 4, 5, 9, and 10 each have 8 squares to cover before they reach the finish line— where if the starting point of the race is at the 4F (4 furlong) point, the horses numbered 6, 7, and 8 each have 6 squares to cover before they reach the finish line and the horses numbered 4, 5, 9, and 10 each have 4 squares to cover before they reach the finish line— where if there is only one starting point for the race, the horses numbered 6, 7, and 8 each have 6 squares to cover before they reach the finish line and the horses numbered 4, 5, 9, and 10 each have 4 squares to cover before they reach the finish line— where regardless of which starting point is used the number of squares in the horse racing lanes needed to be covered to go from the starting point to the finishing point for the purpose of winning a race for the 6, 7, or 8 horses as compared to the 4, 5, 9, or 10 horses has a ratio of 3 to 2, seven different horse playing pieces which are numbered 4, 5, 6, 7, 8, 9, and 10, betting areas for each horse bet that is offered, betting areas for each craps bet that is offered, separate horse betting areas from other players for each person playing the game to bet on each of the seven horses that are racing, separate betting areas from other players for each person playing the game to bet on each of the craps bets that are offered, craps wagers offered which include place bets, pass-line bets, don't pass-line bets, laying odds bets, taking odds bets, hardway bets, field bets, and C-E-7 bets, "race closed" buttons to cap the horse bets which are placed on top of each horse bet for the purpose of not allowing any additional horse betting in the middle of a race, an "on-off" button which a dealer uses to mark a point in a traditional game of craps, casino chips to make horse bets and craps bets, two traditional 6-sided dice cubes which are "rolled" by one of the players whereby the arithmetic total of the two dice of a particular roll determines which horse to move and at the same time determines the outcome of the craps betting;

step 1—to start the game the dealer places the "on-off" button used in a craps game with the "off" side facing up to designate it is a come-out roll for the craps game; and then the dealer places all of the horses in their starting point, depending on which game playing surface is used:

if the game playing surface has only one starting point for the horses, then the dealer places all of the horses in their own corresponding starting point which is designated by the word "start";

but if the game playing surface has more than one starting point (1½ mile, 1 mile, 4F), then the dealer places the horses in their corresponding starting point, either starting the horse race at the 1½ mile, 1 mile, or 4F starting points, depending on which race was run previously:

if it is the very $1^{st}$ race when the game opens for the day, then the 1½ mile starting point should be used;

the $2^{nd}$ race should start from the 1 mile starting point;

the $3^{rd}$ race should start from the 4F (4 Furlongs) starting point;

the $4^{th}$ race should start from the 1½ mile starting point;

the $5^{th}$ race should start from the 1 mile starting point;

and so on;

then proceed to step 2, step 2—the players place their bets on the offered horse bets (as many as they would like) in the areas directly in front of them, where they each have their own distinct betting areas;

then proceed to step 3, step 3—the dealer caps the horse bets by placing a button on them which says "race closed" which is to designate that no more horse bets will be accepted until the current race is over;

then proceed to step 4, step 4—the players place their bets on the offered craps-bets in the areas directly in front of them, where they each have their own distinct betting areas;

then proceed to step 5, step 5—the dice are "thrown" by the player whose turn it is to shoot the dice in the craps-game;

then proceed to step 6, step 6—the dealer moves one of the horses based on the following rules 6(a), (b), (c), (d), provided there is an active horse race:

(a) if the total of the two dice is 2, 3, or 12 and it is the come-out roll in the craps-game, then the 7-horse is moved backwards one square—

(b) if the total of the two dice is 11 and it is the come-out roll in the craps-game, then the 7-horse is moved forward 2 squares—

(c) if the total of the two dice is 4, 5, 6, 7, 8, 9, or 10:

and doubles are not thrown, the corresponding horse is moved forward 1 square, but if doubles (hardways) are thrown (both dice are the same number), the corresponding horse is moved forward 2 squares—

(for example, if there is a "3" on both dice, then the 6-horse would move forward 2 squares, but if there is a "1" on one die and a "5" on the other die, then the 6-horse would move forward only 1 square)—

(d) if one of the horses crosses the finish line either on a single move or a double move, the horse race is over and the horse that crossed the finish line is the winner, and all of the other horses are losers, and then the dealer waits for the next come-out roll in the craps game before re-setting all of the horses at their starting point— then proceed to step 7, step 7—the dealer removes the losing bets (if any) from the playing surface, both craps-game bets and horse bets;

then proceed to step 8, step 8—the dealer pays the winning bets (if any) for both craps-game bets and horse bets;

then proceed to step 9, step 9—if it is not the come-out roll for the craps-game (the "on-off" button shows "on"), then proceed to step 10;

else if it is the come-out roll for the craps-game (the "on-off" button shows "off")

and if the total of the two dice is 2, 3, 7, 11, or 12, the dealer leaves the "on-off" button set to "off", it remains the come-out roll for the craps-game, and if the horse race is over—proceed to step 1, else proceed to step 4;

but if the total of the two dice is 4, 5, 6, 8, 9, or 10, the dealer rotates the "on-off" button to "on", and marks the number that was just thrown with the button;

then proceed to step 4, step 10—if it is not the come-out roll for the craps-game (the "on-off" button shows "on" and it is marking one of the numbers which is known as the "point" in craps)

and if the total of the two dice is equal to 7 or if the total is equal to the number which is marked with "on" (the point), then the dealer rotates the button to "off", removes it from the number which it was on, and if the horse race is over—proceed to step 1, else proceed to step 4;

but if the total of the two dice is some number other than 7 or the "point", then the dealer leaves the "on-off" button marking the number that it is "on";

then proceed to step 4.

2. A method of playing a game according to claim 1 where the dice are "rolled by one of the players whereby whether or not it is the "come out" roll in the craps game, affects the movement of the 7-horse.

3. A method of playing a game according to claim 1 where prior to the start of a horse race, players place their bets on the horses and then are not allowed to change their horse bets until the race is over.

4. A method of playing a game according to claim 1 where each new horse race only starts when it is the "come out" roll in the craps game which is being played simultaneously.

5. A method of playing a game according to claim 1 where players place their craps bets based on the betting rules of craps and the payout of these craps bets is being determined by the same roll of the same dice which are controlling the horse race which is happening simultaneously on the same playing surface.

* * * * *